US008689749B2

(12) United States Patent
Suzuki et al.

(10) Patent No.: US 8,689,749 B2
(45) Date of Patent: Apr. 8, 2014

(54) VALVE TIMING CONTROLLER

(75) Inventors: Masanori Suzuki, Nukata-gun (JP); Yoshiyuki Murao, Kariya (JP)

(73) Assignee: Denso Corporation, Kariya (JP)

( * ) Notice: Subject to any disclaimer, the term of this patent is extended or adjusted under 35 U.S.C. 154(b) by 58 days.

(21) Appl. No.: 13/612,969

(22) Filed: Sep. 13, 2012

(65) Prior Publication Data

US 2013/0134338 A1 May 30, 2013

(30) Foreign Application Priority Data

Nov. 24, 2011 (JP) ..... 2011-256563

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34423* (2013.01)
USPC ..... 123/90.17; 123/90.15; 251/129.15; 335/255; 464/160

(58) Field of Classification Search
USPC ..... 123/90.15, 90.17; 251/129.15; 335/255; 464/160
See application file for complete search history.

(56) References Cited

U.S. PATENT DOCUMENTS 7,444,964 B2 * 11/2008 Kanada et al. ..... 123/90.15
2004/0257185 A1 12/2004 Telep
2010/0313835 A1 12/2010 Yamaguchi et al.

* cited by examiner

*Primary Examiner* — Ching Chang
(74) *Attorney, Agent, or Firm* — Nixon & Vanderhye PC

(57) ABSTRACT

A valve timing controller has a control valve and a linear solenoid. The control valve is disposed in an interlocking rotor constructed by a vane rotor and a camshaft. The linear solenoid includes a movable member having an output shaft, and a bearing portion supporting the movable member to reciprocate and rotate. A spool of the control valve is contact with the output shaft. The output shaft contacts a sphere-shaped end surface of the spool, at a contact position offset in a radial direction from a center axis of the spool.

9 Claims, 7 Drawing Sheets

VALVE TIMING CONTROLLER

CROSS REFERENCE TO RELATED APPLICATION

This application is based on Japanese Patent Application No. 2011-256563 filed on Nov. 24, 2011, the disclosure of which is incorporated herein by reference in its entirety.

TECHNICAL FIELD

The present disclosure relates to a valve timing controller.

BACKGROUND

JP-2010-285918A (US 2010/0313835) describes a valve timing controller including a housing rotated with a crankshaft and a vane rotor rotated with a camshaft. The vane rotor partitions an inside space of the housing into an advance chamber and a retard chamber in a rotation direction, and working fluid is introduced into the advance chamber or the retard chamber, so that a rotation phase of the vane rotor is changed relative to the housing on the advance side or the retard side.

The valve timing controller has a control valve and a linear solenoid. The control valve controls a flow of the working fluid relative to the advance chamber and the retard chamber by reciprocating a spool in a sleeve in an axial direction. The linear solenoid drives the spool to reciprocate in the axial direction.

JP-2005-45217A (US 2004/0257185) describes such a linear solenoid, in which a magnetic flux generated by a coil passes through a movable core and a fixed core, thereby reciprocating an output shaft in an axial direction together with the movable core. Here, in JP-2010-285918A, the spool is pressingly contact with the output shaft because the spool is biased toward the output shaft by a spring, so the spool can quickly move by following the reciprocation of the output shaft.

In JP-2005-45217A, if a side force is generated to draw the movable core toward the fixed core located on the outer circumference side of the movable core in a radial direction, a movable body integrally constructed by the movable core and the output shaft is pressed against a bearing which supports the movable body from the outer circumference side. At this time, in JP-2010-285918A, the spool may rotate with an interlocking rotor constructed by a vane rotor and a camshaft, and the rotation torque is transmitted to the output shaft from the spool.

In JP-2010-285918A, a sphere-shaped end face of the spool coaxially contacts with a flat end surface of the output shaft, which is perpendicular to the axial direction. In this case, the sphere-shaped end face of the spool and the flat end surface of the output shaft slip with each other, and the transmission of the rotation torque from the spool to the movable body may become intermittent. When the rotation torque is not transmitted from the spool to the output shaft, the movable body starts to reciprocate in the axial direction from the static-friction state, so the friction resistance becomes large between the movable body and the bearing.

If the friction resistance is varied, hysteresis produced between a forward movement and a backward movement of the reciprocation may be increased in the movable body. Further, a stick slip may be caused, so that the reciprocation of the movable body may become intermittent. The hysteresis and the stick slip may lower the control performance of the spool of the control valve which is driven by the movable body.

SUMMARY

It is an object of the present disclosure to provide a valve timing controller having high control performance.

According to an example of the present disclosure, a valve timing controller controls a valve timing of a valve opened and closed by a torque transmitted to a camshaft from a crankshaft of an internal combustion engine, and includes a housing rotating with the crankshaft, a vane rotor rotating with the camshaft, a control valve, and a linear solenoid. The vane rotor partitions an interior space of the housing into an advance chamber and a retard chamber in a rotation direction. A rotation phase of the vane rotor relative to the housing is changed in an advance direction or a retard direction by introducing working fluid into the advance chamber or the retard chamber. The control valve is disposed in an interlocking rotor constructed by the vane rotor and the camshaft, and has a sleeve and a spool. The working fluid flows in the sleeve. The spool reciprocates in the sleeve in an axial direction. The control valve controls a flow of the working fluid relative to the advance chamber and the retard chamber based on a reciprocation of the spool in the sleeve. The linear solenoid drives the spool to reciprocate in the axial direction, and includes a coil, a cylindrical fixed core, a movable member and a bearing portion. The coil generates a magnetic flux by being supplied with electricity. The magnetic flux passes through the cylindrical fixed core. The movable member integrally has a movable core disposed on an inner circumference side of the fixed core and an output shaft reciprocating in the axial direction together with the movable core when the magnetic flux passes the fixed core and the movable core. The bearing portion supports an outer circumference side of the movable member in a manner that the movable member reciprocates and rotates. The output shaft has an end surface that contacts a sphere-shaped end face of the spool, at a contact position offset in a radial direction from a center axis of the spool.

Accordingly, the control performance of the valve timing controller can be raised.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
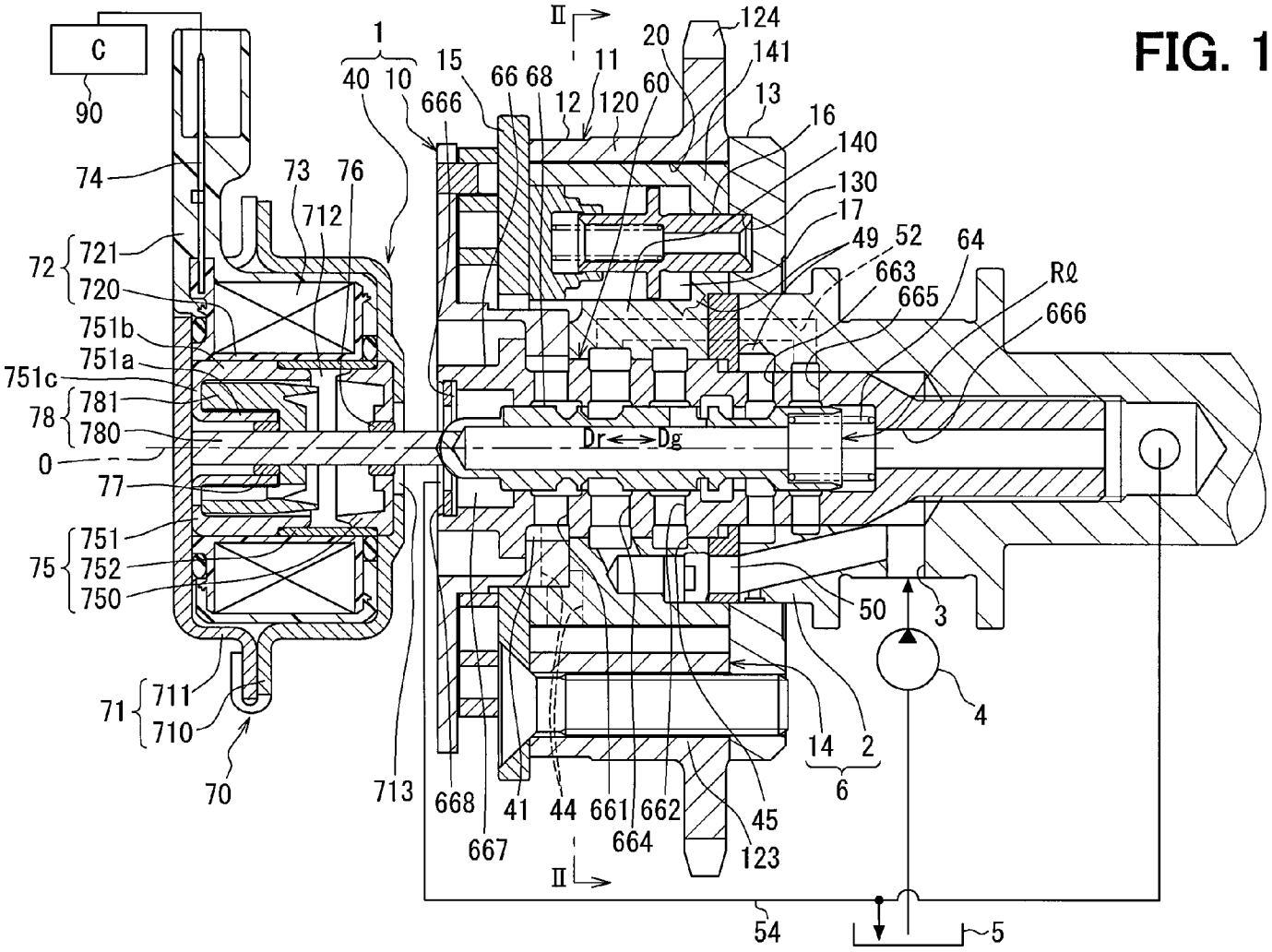
FIG. 1 is a schematic cross-sectional view illustrating a valve timing controller according to a first embodiment, in which a spool is located in a lock region.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A valve timing controller 1 according to a first embodiment is applied to an internal combustion engine for a vehicle. The valve timing controller 1 is operated using working fluid such as oil, and controls a valve timing of an intake valve that is opened and closed by a camshaft 2 to which a torque of the engine is transmitted.

Figure 2:
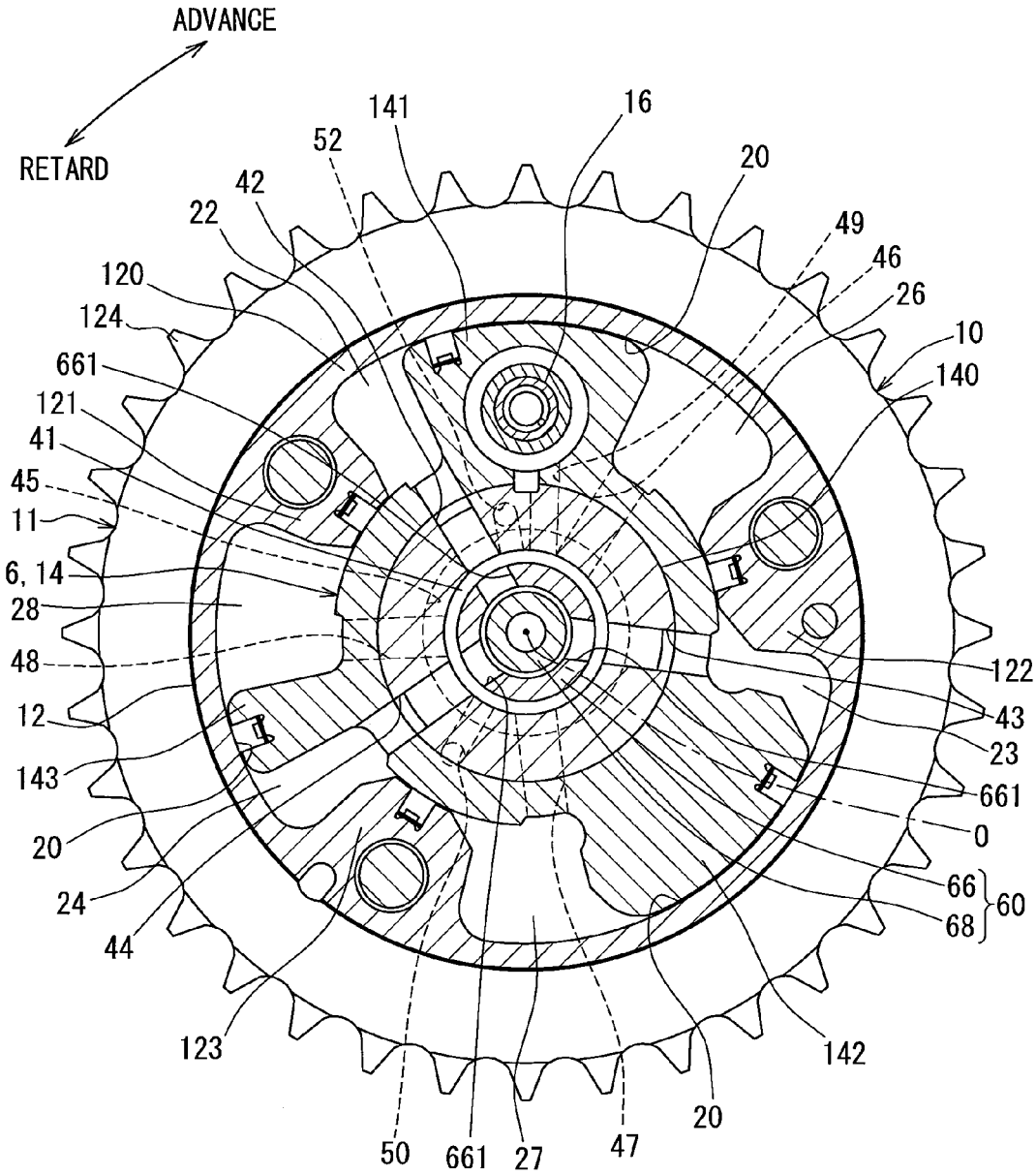
FIG. 2 is a schematic cross-sectional view taken along a line II-II of FIG. 1.

A basic structure of the valve timing controller 1 will be described hereinafter. As shown in FIGS. 1 and 2, the valve timing controller 1 has a mechanism part 10 and a control part 40. The mechanism part 10 is disposed in a transmission system which transmits the torque output from a crankshaft (not shown) of the engine to the camshaft 2. The control part 40 controls a flow of working fluid to drive the mechanism part 10.

As shown in FIG. 1, the mechanism part 10 includes a housing 11 made of metal, and the housing 11 has a shoe ring 12, a rear plate 13 and a front plate 15. The rear plate 13 and the front plate 15 are respectively tightened to ends of the shoe ring 12 in the axial direction. As shown in FIG. 2, the shoe ring 12 includes a cylindrical housing body 120, plural shoes 121, 122, 123, and a sprocket 124. The shoes 121, 122, 123 are circumferentially arranged one after another at generally equal intervals on an inner surface of the housing body 120, and project inward in the radial direction.

A receiving chamber 20 is defined between the adjacent shoes 121, 122, 123 located adjacent with each other in a rotation (circumference) direction. The sprocket 124 is connected or linked with the crankshaft via a timing chain (not shown). During an operation of the internal combustion engine, a driving torque is transmitted from the crankshaft to the sprocket 124 such that the housing 11 rotates in a predetermined direction (clockwise in FIG. 2) together with the crankshaft.

A vane rotor 14 made of metal is coaxially received in the housing 11, and axial ends of the vane rotor 14 slidably move relative to the rear plate 13 and the front plate 15, respectively. The vane rotor 14 includes a rotary shaft 140 and plural vanes 141, 142, 143. The rotary shaft 140 is coaxially connected to the camshaft 2, and an interlocking rotor 6 is defined by the rotary shaft 140 and the camshaft 2. The vane rotor 14 is rotatable in the same direction as the housing 11 (clockwise in FIG. 2), and is relatively rotatable relative to the housing 11.

The vanes 141, 142, 143 protrude radially outwardly from the rotary shaft 140 at generally equal intervals in the rotation direction and are accommodated in the corresponding receiving chamber 20 respectively. Each of the vanes 141, 142, 143 divides the corresponding receiving chamber 20 into two chambers in the rotation direction in the housing 11.

Specifically, an advance chamber 22 is defined between the shoe 121 and the vane 141, an advance chamber 23 is defined between the shoe 122 and the vane 142, and an advance chamber 24 is defined between the shoe 123 and the vane 143, respectively. Further, a retard chamber 26 is defined between the shoe 122 and the vane 141, a retard chamber 27 is defined between the shoe 123 and the vane 142, and the a retard chamber 28 is defined between the shoe 121 and the vane 143, respectively.

Figure 3:
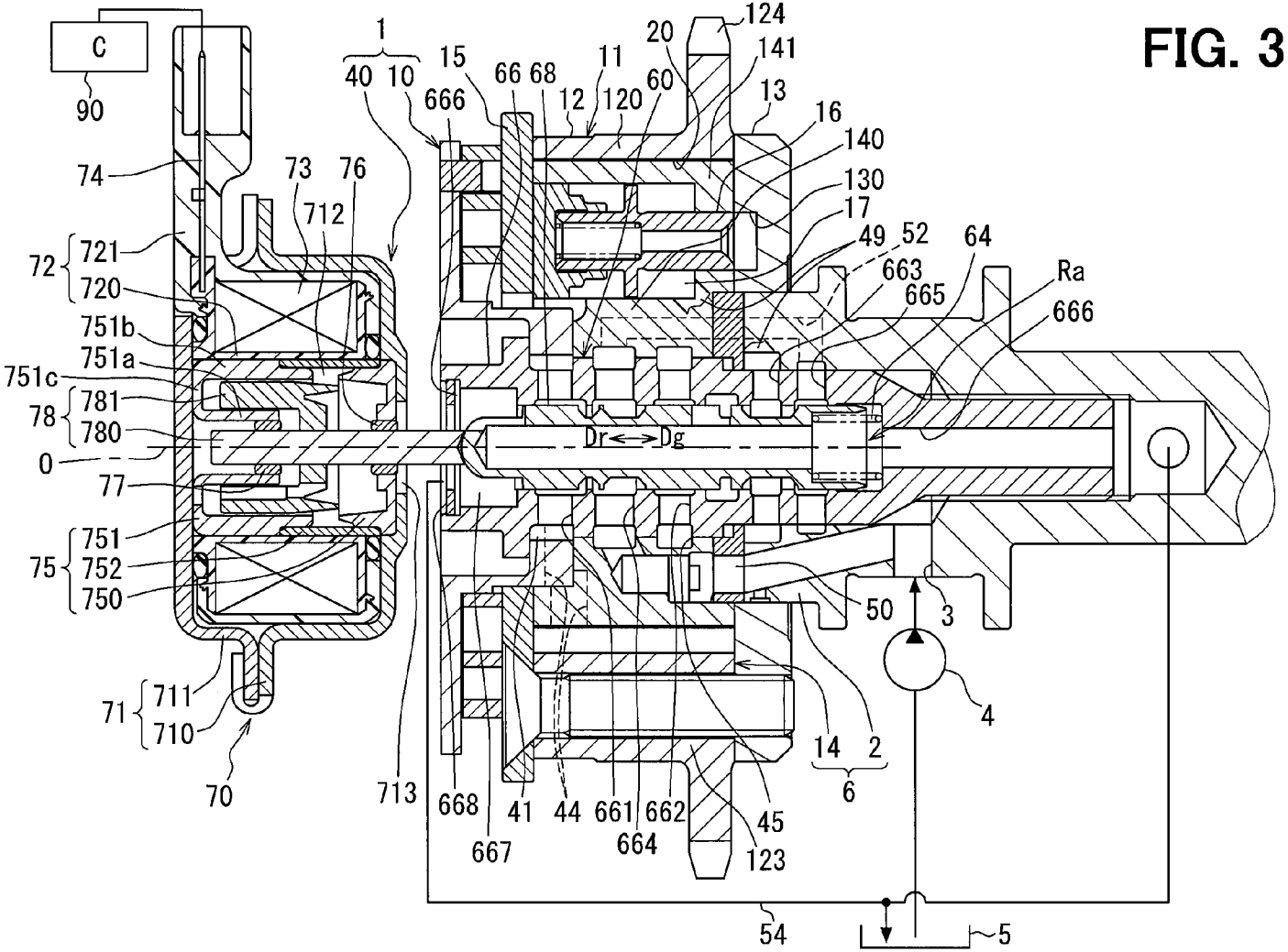
FIG. 3 is a schematic cross-sectional view illustrating the valve timing controller of the first embodiment, in which the spool is located in an advance region.
Figure 4:
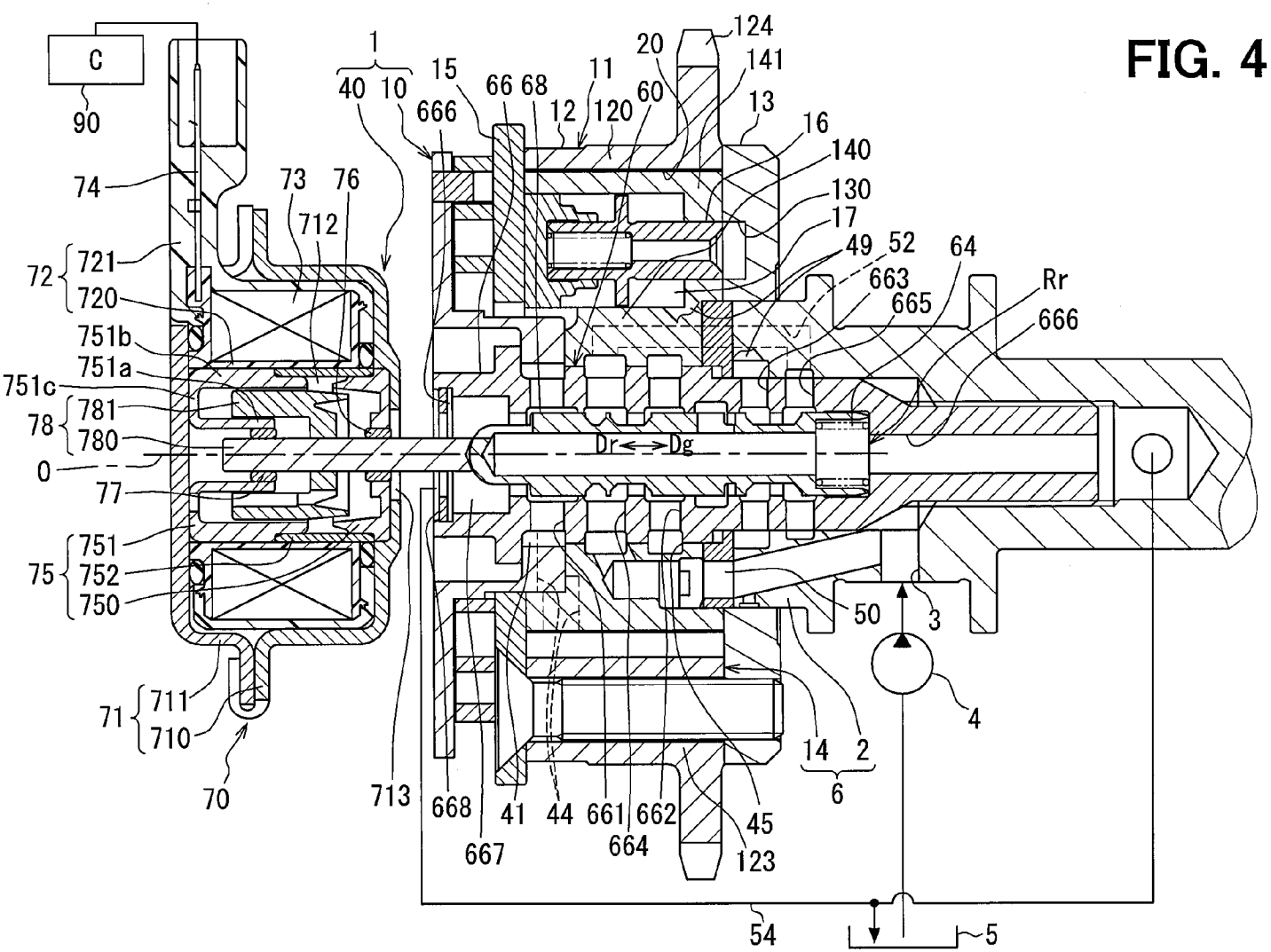
FIG. 4 is a schematic cross-sectional view illustrating the valve timing controller of the first embodiment, in which the spool is located in a retard region.

The vane 141 has a lock component 16 to be fitted with a lock hole 130 defined in the rear plate 13 so as to lock the rotation phase of the vane rotor 14 relative to the housing 11, as shown in FIG. 1. Further, the vane 141 defines a lock release chamber 17 into which working fluid is introduced, in order to make the lock component 16 to come out of the lock hole 130 so as to cancel the lock of the rotation phase, as shown in FIGS. 3 and 4.

While the rotation phase is unlocked, when working fluid is introduced into the advance chambers 22, 23, 24 and is discharged from the retard chambers 26, 27, 28, the rotation phase is changed in the advance direction to advance the valve timing.

While the rotation phase is unlocked, when working fluid is introduced into the retard chambers 26, 27, 28 and is discharged from the advance chambers 22, 23, 24, the rotation phase is changed in the retard direction to retard the valve timing.

The control part 40 will be specifically described below. A main advance passage 41 is formed to extend along an inner periphery of the shaft 140. Branch advance passages 42, 43, 44 penetrate the shaft 140, and are communicated to the corresponding advance chamber 22, 23, 24, respectively, and the main advance passage 41 which is common.

A main retard passage 45 is defined by a groove opened in the inner periphery of the shaft 140. Branch retard passages 46, 47, 48 penetrate the shaft 140 and are communicated to the corresponding retard chamber 26, 27, 28, respectively, and the main retard passage 45 which is common. A lock release passage 49 penetrates the shaft 140, and is communicated with the lock release chamber 17.

A main supply passage 50 penetrates the shaft 140, and is communicated with a pump 4 through a pump passage 3 of the camshaft 2. The pump 4 may be a mechanical pump driven by rotation of the engine through the crankshaft, and may correspond to a supply source. While the engine is rotated, the pump 4 pumps up working fluid from an oil pan 5 and continuously discharges the working fluid. The pump passage 3 always communicates with a discharge port of the pump 4 without respect to the rotation of the camshaft 2. Thus, while the engine is operated, working fluid discharged from the pump 4 is continuously introduced into the main supply passage 50.

A sub-supply passage 52 penetrates the shaft 140, and is branched from the main supply passage 50. The sub-supply passage 52 receives the working fluid from the pump 4 through the main supply passage 50. As shown in FIG. 1, a drain collecting passage 54 is arranged outside of the mechanism part 10 and the camshaft 2. The drain collecting passage 54 is communicated with atmospheric air, and discharges working fluid to the drain pan 5. The drain collecting passage 54 and the drain pan 5 may correspond to a drain collecting portion.

A control valve 60 has a spool 68 reciprocating in an axial direction using a driving force generated by a linear solenoid 70 and a restoring force of a biasing component 64 generated in a direction opposite from the driving force. The control valve 60 controls a flow of working fluid relative to the chambers 17, 22, 23, 24, 26, 27, 28 in accordance with the reciprocation of the spool 68.

A controlling circuit 90 is an electronic circuit constructed by, for example, a microcomputer, and is electrically connected with the linear solenoid 70 and various electronic parts (not shown) of the engine. The controlling circuit 90 controls rotation of the engine and energization of the linear solenoid 70 based on a computer program stored in an internal memory.

Next, the control valve 60 will be described in detail with reference to FIGS. 1, 3 and 4. FIG. 1 illustrates a state where the spool 68 is located in a lock region Rl. FIG. 3 illustrates a state where the spool 68 is located in an advance region Ra. FIG. 4 illustrates a state where the spool 68 is located in a retard region Rr.

The control valve 60 has a sleeve 66 in addition to the spool 68 and the biasing component 64. The control valve 60 is coaxially arranged inside the interlocking rotor 6 defined by the camshaft 2 and the vane rotor 14, so the sleeve 66, the spool 68, and the biasing component 64 of the control valve 60 are rotatable integrally with the interlocking rotor 6.

The sleeve 66 made of metal has a based cylindrical shape having an advance port 661, a retard port 662, a lock release port 663, a main supply port 664, a sub-supply port 665, and two drain ports 666. As shown in FIG. 1, the advance port 661 communicates with the main advance passage 41, the retard port 662 communicates with the main retard passage 45, and the lock release port 663 communicates with the lock release passage 49. Moreover, the main supply port 664 communicates with the main supply passage 50, the sub-supply port 665 communicates with the sub-supply passage 52, and the drain ports 666 communicate with the drain collecting passage 54.

Figure 5:
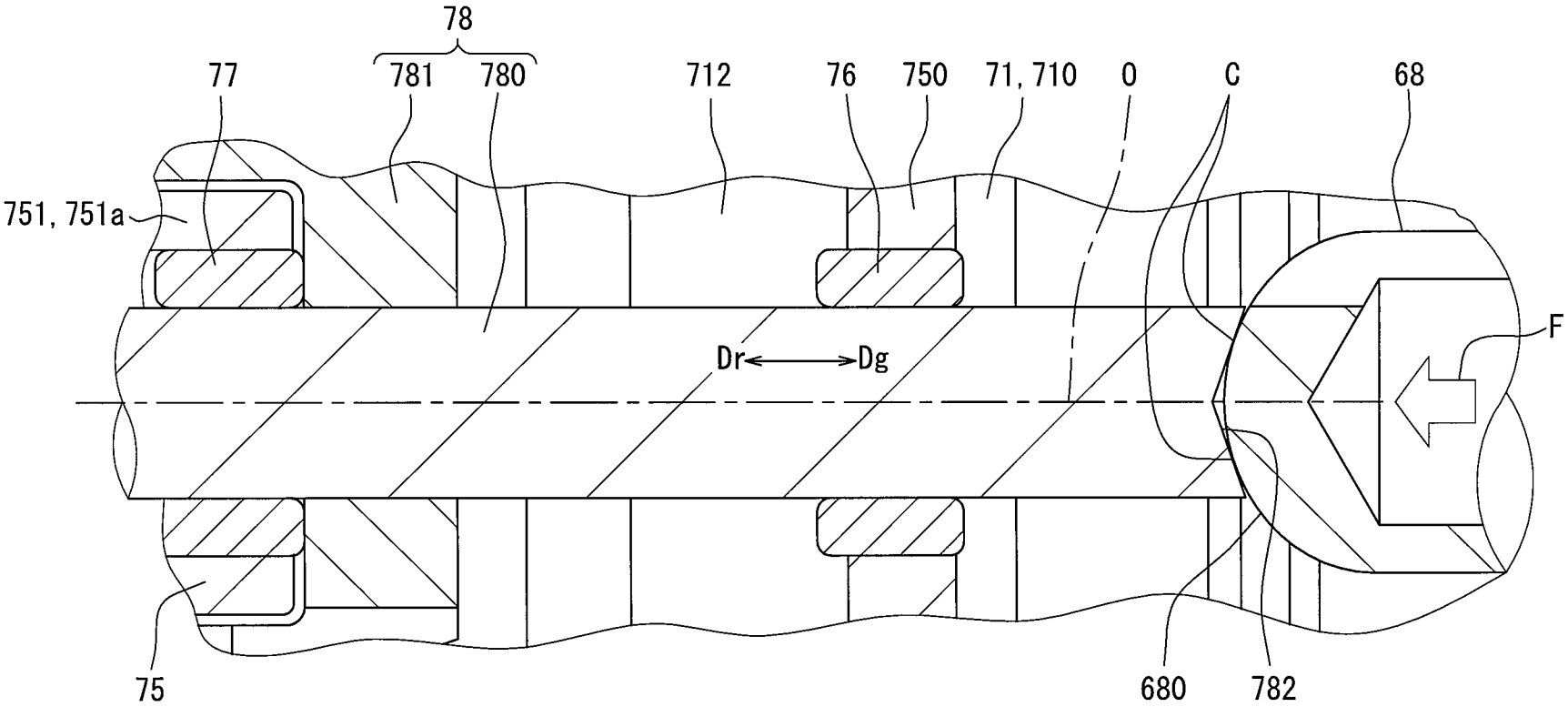
FIG. 5 is a schematic enlarged view of FIG. 1 illustrating a linear solenoid of the valve timing controller of the first embodiment.

The spool 68 made of metal has a cylindrical shape, and is coaxially accommodated in the sleeve 66, thereby reciprocating along a center axis O between a forward direction Dg and a backward direction Dr opposite from each other. A first end of the spool 68 in the backward direction Dr, as shown in FIG. 5, has a sphere-shaped end face 680 which presents approximately hemisphere surface shape.

As shown in FIG. 1, the biasing component 64 made of metal compression coil spring is coaxially accommodated in the sleeve 66, and is interposed between a second end of the spool 68 in the forward direction Dg and the sleeve 66 in the axial direction. Thus, the biasing component 64 biases the spool 68 in the backward direction Dr.

The control valve 60 switches the communication state among the ports 661, 662, 663, 664, 665, 666 in accordance with the reciprocation of the spool 68, as shown in FIGS. 1, 3, and 4. Thus, the control valve 60 controls the flow of working fluid relative to the chambers 17, 22, 23, 24, 26, 27, 28.

Specifically, when the spool 68 is located in the lock region Rl of FIG. 1, the advance port 661 communicates with the main supply port 664, and the working fluid is introduced into the advance chambers 22, 23, 24 from the pump 4. Further, in the lock region Rl, the retard port 662 and the lock release port 663 communicate with the corresponding drain port 666, and the working fluid is discharged into the drain pan 5 from the retard chambers 26, 27, 28 and the lock release chamber 17. Therefore, the rotation phase is locked.

In the advance region Ra of FIG. 3, the advance port 661 and the lock release port 663 respectively communicate with the main supply port 664 and the sub-supply port 665, and the working fluid is introduced into the advance chambers 22, 23, 24 and the lock release chamber 17 from the pump 4. Further, in the advance region Ra, the retard port 662 communicates with the drain port 666, and the working fluid is discharged from the retard chambers 26, 27, 28 into the drain pan 5. As a result, the rotation phase is changed in the advance direction to advance the valve timing while the rotation phase is unlocked.

In the retard region Rr of FIG. 4, the retard port 662 and the lock release port 663 respectively communicate with the main supply port 664 and the sub-supply port 665, and the working fluid is introduced into the retard chambers 26, 27, 28 and the lock release chamber 17 from the pump 4. Further, in the retard region Rr, the advance port 661 communicates with the drain port 666, and the working fluid is discharged from the advance chambers 22, 23, 24 into the drain pan 5. Therefore, the rotation phase is changed in the retard direction to retard the valve timing while the rotation phase is unlocked.

Working fluid passes through an interior space 667 of the sleeve 66 of the control valve 60. The sleeve 66 has an opening 668 communicating with the interior space 667, and the opening 668 corresponds to one of the drain ports 666 adjacent to the linear solenoid 70. In each of the regions Rl, Ra, Rr, working fluid is discharged from the opening 668 into the drain pan 5 through the drain collecting passage 54.

Next, the linear solenoid 70 which drives the spool 68 will be explained in detail with reference to FIGS. 1, 3, and 4. FIG. 1 illustrates a state where the linear solenoid 70 drives the spool 68 to be located in the lock region Rl. FIG. 3 illustrates a state where the linear solenoid 70 drives the spool 68 to be located in the advance region Ra. FIG. 4 illustrates a state where the linear solenoid 70 drives the spool 68 to be located in the retard region Rr.

As shown in FIG. 1, the linear solenoid 70 has a flat-shaped casing 71, a mold case 72, a coil 73, a terminal 74, a fixed core 75, a rear bearing 76, a front bearing 77, and a movable body 78.

The casing 71 is fixed to a fixed frame of the engine such as a gear case, and the position of the casing 71 is fixed relative to the control valve 60 integrally rotating with the interlocking rotor 6. The casing 71 made of magnetic material is constructed by integrally assembling a rear cup 710 and a front cup 711, and has a hollow shape defining an internal chamber 712.

The rear cup 710 has a based cylindrical shape, and is arranged in a manner that a bottom of the cup 710 coaxially opposes the opening 668 of the sleeve 66 from which the working fluid is discharged from the interior space 667 of the sleeve 66. The bottom of the rear cup 710 has a respiratory through hole 713 through which the internal chamber 712 communicates with atmospheric air. A part of the working fluid discharged from the sleeve 66 into the drain port 666 adjacent to the linear solenoid 70 flows into the internal chamber 712 of the casing 71 through the opening 668 and the respiratory hole 713.

The front cup 711 has a based cylindrical shape and is arranged opposite from the sleeve 66 through the rear cup 710 in the axial direction, and is located on the same axis as the rear cup 710 and the sleeve 66.

The mold case 72 is made of nonmagnetic resin, and is arranged to extend between inside and outside of the casing 71. A portion of the mold case 72 accommodated in the internal chamber 712 of the casing 71 corresponds to a bobbin 720 around which the coil 73 is fixed. The other portion of the mold case 72 projected outward from the casing 71 corresponds to a connector 721 which covers the terminal 74 made of metal.

The coil 73 has a cylindrical shape as a whole by winding a metal wire, and is accommodated in the internal chamber 712 of the casing 71 to be disposed on the same axis as the cup 710, 711. The metal wire of the coil 73 is electrically connected with the controlling circuit 90 through the terminal 74. The coil 73 is magnetized by being supplied with electricity from the controlling circuit 90, and generates a magnetic flux.

The fixed core 75 has a rear component 750, a front component 751 and a spacer 752, and is accommodated in the internal chamber 712 of the casing 71. The rear component 750 has a cylindrical shape and is made of magnetic material, and is coaxially arranged on the inner circumference side of the coil 73 through the bobbin 720. A first end of the rear component 750 in the forward direction Dg contacts the bottom of the rear cup 710 in the axial direction. The front component 751 has a double cylindrical shape and is made of magnetic material, and is coaxially arranged on the inner circumference side of the coil 73 through the bobbin 720.

The front component 751 has an inner cylinder 751*a*, an outer cylinder 751*b* and a connector 751*c*. The inner cylinder 751*a* is located inside of the outer cylinder 751*b*, and the connector 751*c* connects the inner cylinder 751*a* to the outer cylinder 751*b* at the ends in the backward direction Dr. The connector 751*c* contacts with a bottom of the front cup 711 in the axial direction. Moreover, an end of the outer cylinder 751*b* of the front component 751 in the forward direction Dg opposes an end of the rear component 750 in the backward direction Dr in the axial direction.

The spacer 752 has a cylindrical shape and is made of nonmagnetic material, and is coaxially arranged on the inner circumference side of the coil 73 through the bobbin 720. The spacer 752 is coaxially fitted with the outer circumference surface of the rear component 750 and the outer circumference surface of the front component 751. Thus, the magnetic flux generated by the coil 73 is restricted from having a short circuit in a gap between the rear component 750 and the front component 751.

As shown in FIGS. 1 and 5, the bearing 76, 77 is a bush-type cylindrical metal bearing, and is accommodated in the internal chamber 712 of the casing 71. The rear bearing 76 is fixed to the casing 71 through the rear component 750 by being coaxially fitted into the rear component 750. The front bearing 77 is fixed to the casing 71 through the front component 751 by being coaxially fitted into the inner cylinder 751*a* of the front component 751.

The movable body 78 is constructed by integrally assembling an output shaft 780 and a movable core 781. The output shaft 780 has a cylindrical shape mate of metal, and penetrates the casing 71 at the bottom of the rear cup 710. The output shaft 780 is slidably fitted with the rear bearing 76 and the front bearing 77, which are located at two positions spaced from each other in the axial direction. The output shaft 780 is supported by the bearing 76, 77 from the outer circumference side so as to be reciprocate both in the forward direction Dg and the backward direction Dr and so as to be rotatable in the rotation direction.

As shown in FIG. 5, an end of the output shaft 780 in the forward direction Dg has a concave surface 782. The concave surface 782 may be referred as a tapered surface. When the spool 68 is pressed against the output shaft 780 by the restoring force F of the biasing component 64, the spool 68 contacts the concave surface 782 of the output shaft 780. The concave surface 782 is a cone-shaped surface in which the diameter is gradually decreased as separating from the spool 68 in the axial direction of the output shaft 780, thereby forming a slant surface slanted relative to a plane perpendicular to the axial direction.

The concave surface 782 contacts the sphere-shaped end face 680 of the spool 68, while the spool 68 is biased by the restoring force F of the biasing component 64 toward the output shaft 780 in the axial direction, at a contact position C defining approximately circumference shape. The contact position C is off-centered in the radial direction from the center axis O of the spool 68. In other words, the output shaft 780 and the spool 68 annually and linearly contact with each other, and integrally move toward a specified position in the axial direction between the forward direction Dg and the backward direction Dr.

As shown in FIG. 1, the movable core 781 has a cylindrical shape and is made of magnetic material, and is accommodated in the internal chamber 712 of the casing 71. The movable core 781 is arranged on the inner circumference side of the fixed core 75, and is coaxially fitted with the output shaft 780 from the outer circumference side, so as to reciprocate in the axial direction together with the output shaft 780.

The movable core 781 forms a magnetic circuit together with the rear component 750 and the front component 751 of the fixed core 75. The magnetic flux generated by the coil 73 passes through the magnetic circuit. Thus, the movable core 781 is driven to reciprocate in the forward direction Dg or the backward direction Dr in the axial direction.

Specifically, when the magnetic flux disappears by stopping the energization of the coil 73, as shown in FIG. 1, the end of the movable core 781 is made to contact the connector 751*c* of the front component 751, thus the movable core 781 is restricted from moving in the backward direction Dr. As a result, the spool 68 is located in the lock region Rl.

In contrast, when the energization of the coil 73 is restarted, a magnetic circuit is formed in a manner that the magnetic flux generated by the coil 73 passes the movable core 781 from the connector 751*c* of the front component 751 and further passes the rear component 750. Thereby, the movable core 781 is driven in the forward direction Dg against the restoring force of the biasing component 64, and the spool 68 is also driven in the forward direction Dg by the output shaft 780 against the restoring force.

As a result, the movable core 781 is separated from the connector 751*c* of the front component 751, and a magnetic circuit is formed in a manner that the magnetic flux generated by the coil 73 passes the movable core 781 from the inner cylinder 751*a* of the front component 751 and further passes the rear component 750. Thereby, the movable core 781 is moved in the forward direction Dg, as shown in FIGS. 3 and 4, as an electric current passing through the coil 73 increases. Therefore, the spool 68 moves to the advance region Ra or the retard region Rr.

The density of the magnetic flux of the coil 73 becomes the maximum by supplying the maximum electric current to the coil 73. At this time, the movable core 781 causes the end of the spool 68 to contact an end of the sleeve 66 through the output shaft 780 in the axial direction, as shown in FIG. 4. Therefore, the spool 68 is restricted from moving in the forward direction Dg when located in the retard region Rr.

According to the first embodiment, if a side force is generated to draw the movable core 781 toward the rear component 750 and the front component 751 of the fixed core 75 on the outer circumference side in the linear solenoid 70, the movable body 78 integrally having the movable core 781 and the output shaft 780 is pressed against the bearing 76, 77 which supports from the outer circumference side. At this time, in the control valve 60 arranged inside the interlocking rotor 6, the spool 68 is rotated together with the interlocking rotor 6. In a case where a rotation torque is transmitted to the output shaft 780 of the movable body 78 from the spool 68, dynamical friction arises in the sliding interface between the output shaft 780 of the movable body 78, which is rotating, and the bearing 76, 77.

According to the first embodiment, the sphere-shaped end face 680 of the spool 68 is contacted with the concave surface 782 of the output shaft 780 at the contact position C offset in the radial direction from the center axis O. The concave surface 782 may correspond to a slant face slanted relative to a plane perpendicular to the axial direction. Therefore, the rotation torque corresponding to a moment becomes easy to be transmitted between the sphere-shaped end face 680 and the concave surface 782. Thus, while the transmission of the rotation torque to the output shaft 780 from the spool 68, which rotated with the interlocking rotor 6, is continued by the operation of the engine, the movable body 78 can start the axial movement from the dynamical-friction state against the bearing 76, 77, so variation in the friction resistance can be reduced between the movable body 78 and the bearing 76, 77.

According to the first embodiment, working fluid may flow into the internal chamber 712 of the casing 71 accommodating the fixed core 75 and the movable core 781 from the sleeve 66. A foreign matter contained in the working fluid may enter the internal chamber 712, and may cause a short circuit in the magnetic circuit. In this case, a side force which draws the movable core 781 to the rear component 750 and the front component 751 on the outer circumference side is increased, and the movable body 78 may be strongly pressed onto the bearing 76, 77.

However, because the rotation torque is continuously transmitted to the output shaft 780 from the spool 68, the movable body 78 can start the axial movement from the dynamical-friction state relative to the bearing 76, 77, so variation in the friction resistance can be reduced.

Figure 7:
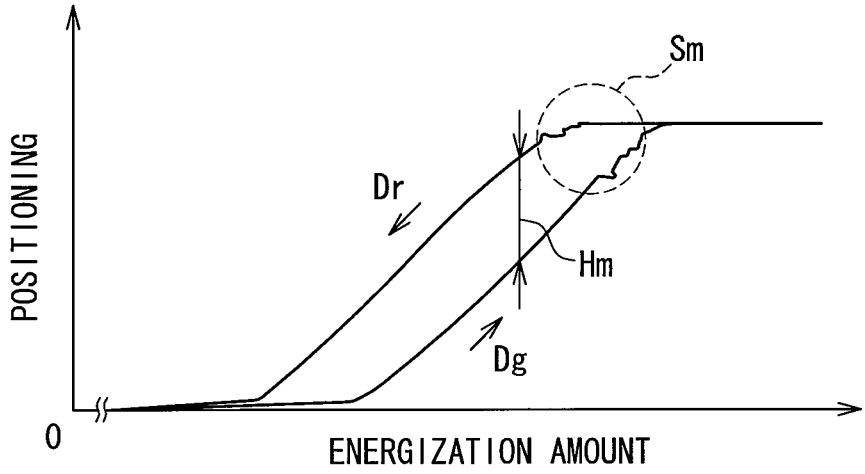
FIG. 7 is a graph illustrating a relationship between an energization amount of a coil and a positioning of a movable member in a valve timing controller of a comparison example in which the movable member is not rotating.

In a comparison example, when the rotation torque is not transmitted from the spool to the output shaft, the movable body starts to reciprocate in the axial direction from the static-friction state, so the friction resistance becomes large between the movable body and the bearing. If the friction resistance is varied, as shown in FIG. 7 illustrating the comparison example, a hysteresis Hm produced between a forward movement and a backward movement may be increased in the movable body. Further, a stick slip Sm may be caused, so that the reciprocation of the movable body may become intermittent. The hysteresis and the stick slip lower the control performance of the spool of the control valve driven by the movable body in the comparison example.

Figure 6:
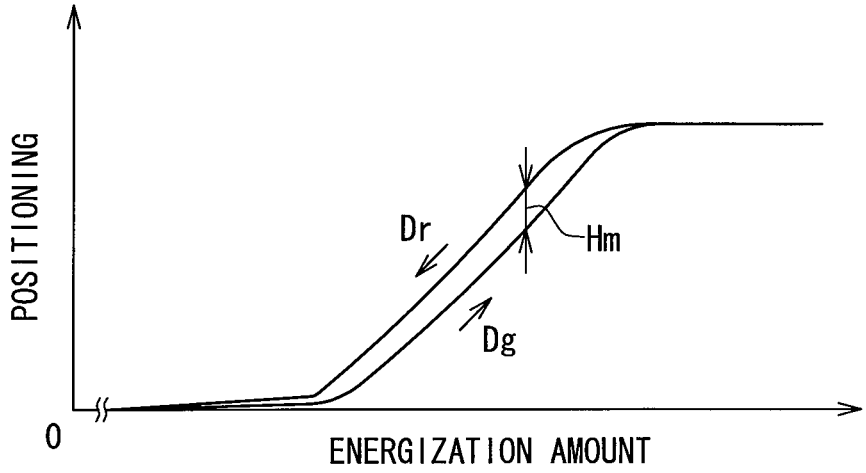
FIG. 6 is a graph illustrating a relationship between an energization amount of a coil and a positioning of a movable member in the valve timing controller of the first embodiment in which the movable member is rotating.

In contrast, according to the first embodiment, as shown in FIG. 6, the hysteresis can be reduced and the stick slip can be eliminated when the movable body 78 has a reciprocation. FIG. 6 illustrates a positioning of the movable body 78 of the first embodiment in the rotating state when the energizing amount to the coil 73 is varied under the condition in which a foreign matter exists in the internal chamber 712 of the casing 71. FIG. 7 illustrates a positioning of the movable body of the comparison example in non-rotating state when the energizing amount to the coil is varied under the same condition.

As clearly shown in a difference between FIG. 6 and FIG. 7, the hysteresis Hm produced between a movement in the forward direction Dg and a movement in the backward direction Dr can be reduced according to the first embodiment in which the movable body 78 starts to move from the rotating state. Further, the stick slip Sm is not generated in the first embodiment.

Thus, even if the movable body 78 is strongly pressed to the bearing 76, 77 by the foreign matter, the hysteresis and the stick slip of the movable body 78 can be reduced. Therefore, the control valve 60 is secured to have the high control performance.

According to the first embodiment, a dimension of the concave surface 782 in the radial direction is reduced as separating from the spool 68 in the axial direction. The sphere-shaped end face 680 of the spool 68 is linearly contact with the output shaft 780 at the contact position C having the circumference shape along the rotation direction. Therefore, a contact resistance between the concave surface 782 and the sphere-shaped end face 680 can be increased, and the rotation torque can be more efficiently transmitted from the spool 68 to the movable body 78.

Because the transmission of the rotation torque can be continued certainly, the variation in the friction resistance can be reduced. Therefore, the hysteresis and the stick slip can be reduced to provide high controllability for the control valve 60.

Further, the sphere-shaped end face 680 of the spool 68 is strongly pressed on the concave surface 782 of the output shaft 780 by the biasing component 64 which biases the spool 68 toward the output shaft 780 in the axial direction. In this state, the contact resistance between the sphere-shaped end face 680 and the concave surface 782 is increased, therefore the rotation torque can be more efficiently transmitted from the spool 68 to the movable body 78. Thus, the transmission of the rotation torque may be certainly continued to the movable body 78, and the variation in the friction resistance is more efficiently reduced. Therefore, the hysteresis and the stick slip can be reduced to provide high controllability for the control valve 60.

(Second Embodiment)

Figure 8:
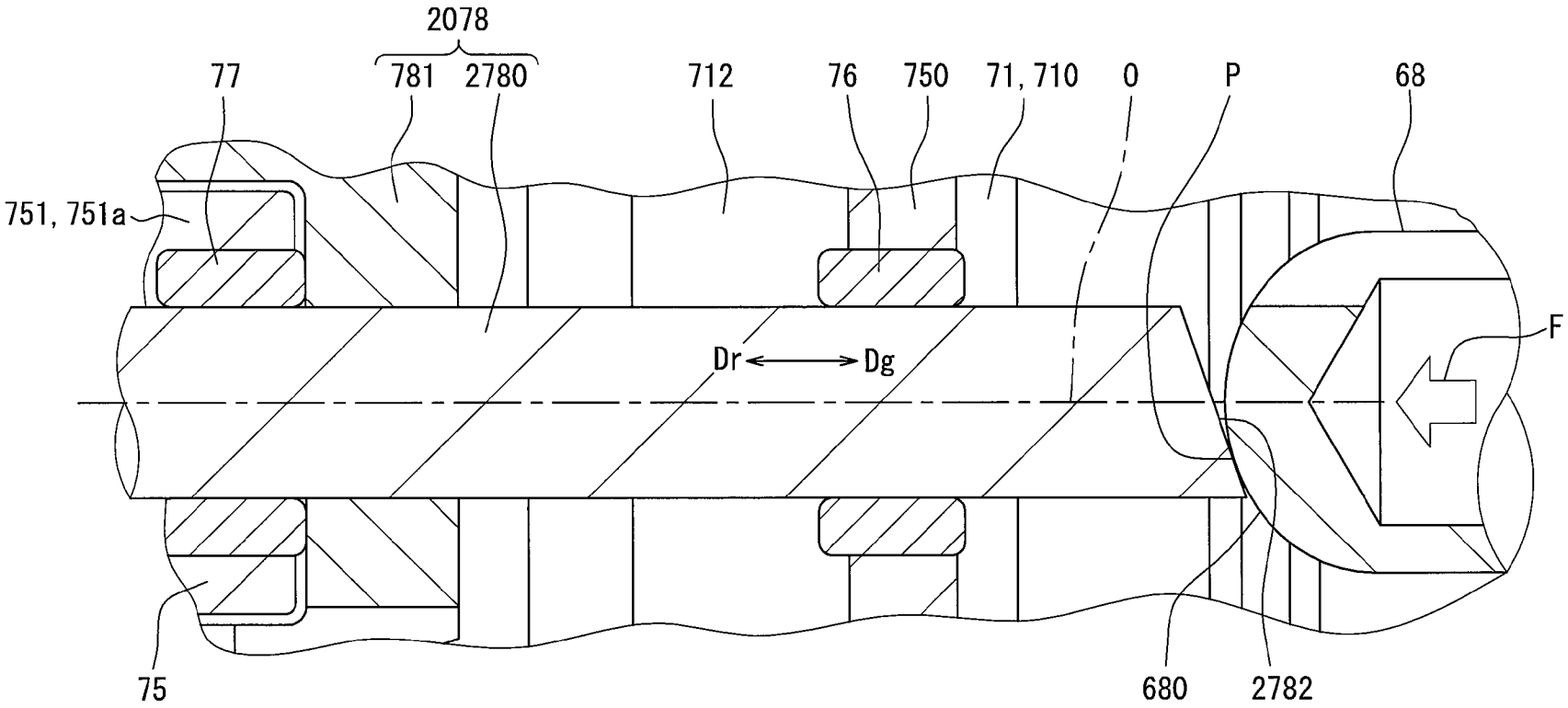
FIG. 8 is a schematic enlarged cross-sectional view illustrating a linear solenoid of a valve timing controller according to a second embodiment.

A second embodiment, which is a modification of the first embodiment, will be described with reference to FIG. 8.

An output shaft 2780 of a movable body 2078 has a slanted flat plane 2782 at the end in the forward direction Dg, instead of the concave surface 782. The slanted flat plane 2782 contacts the sphere-shaped end face 680 of the spool 68 at a contact position P, instead of the contact position C. The slanted flat plane 2782 is a flat surface, and a distance between the slanted flat plane 2782 and the spool 68 in the axial direction is increased as separating from the contact position P in the radial direction. The slanted flat plane 2782 may correspond to a slant face which is inclined to a plane perpendicular to the axial direction.

The slanted flat plane 2782 contacts the sphere-shaped end face 680 of the spool 68 biased by the restoring force F of the biasing component 64 toward the output shaft 2780 in the axial direction, at the contact position P defined by a point which is off-center in the radial direction from the center axis O of the spool 68. The output shaft 2780 and the spool 68 are in the point contact with each other, and integrally move in the forward direction Dg or the backward direction Dr to be located at a specified position in the axial direction.

According to the second embodiment, the sphere-shaped end face 680 of the spool 68 is contacted at the slanted flat plane 2782 of the output shaft 2780 at the contact position P offset from the central axis O. Therefore, the rotation torque corresponding to a moment becomes easy to be transmitted certainly between the slanted flat plane 2782 and the sphere-shaped end face 680. Thus, even if the movable body 2078 is strongly pressed to the bearing 76, 77 by the foreign matter, the axial movement of the output shaft 2780 can be started from the dynamical-friction state while the rotation torque is continuously transmitted. Therefore, the hysteresis and the stick slip can be reduced in the movable body 2078 of the second embodiment to provide high controllability for the control valve 60, because the variation in the friction resistance can be reduced.

Further, the distance between the slanted flat plane 2782 and the spool 68 in the axial direction is increased as separating from the contact position P in the radial direction. The slanted flat plane 2782 is in the point contact with the sphere-shaped end face 680 of the spool 68 at the contact position P defined by a point offset from the center axis O which is perpendicular to the radial direction.

The transmission of the rotation torque corresponding to a moment can be continued between the slanted flat plane 2782 and the sphere-shaped end face 680, therefore the variation in the friction resistance of the movable body 2078 can be reduced, while the sphere-shaped end face 680 is biased by the biasing component 64. Therefore, the hysteresis and the stick slip can be reduced in the movable body 2078 of the second embodiment in which the variation in the friction resistance can be reduced to secure the high controllability for the control valve 60.

(Other Embodiments)

The present disclosure should not be limited to the above embodiments, and may be implemented in other ways without departing from the sprit of the disclosure.

The control valve 60 may be arranged in one of the camshaft 2 and the vane rotor 14, instead of the interlocking rotor 6 constructed by the camshaft 2 and the vane rotor 14. The configuration of the control valve 60 is not limited to the above description if the spool 68 is driven to reciprocate in the sleeve 66 by the linear solenoid 70 in the axial direction.

The output shaft 780, 2780 of the movable body 78, 2078 may be supported by only one of the rear bearing 76 and the front bearing 77. Further, the bearing 76, 77 may support the movable core 781 instead of the output shaft 780, 2780.

The linear solenoid 70 may be configured in a manner that working fluid does not flow into the internal chamber 712 of the casing 71 from the sleeve 66, by not forming the respiratory through hole 713 in the casing 71.

The end of the output shaft 780, 2080 of the linear solenoid 70 such as the concave surface 782 or the slanted flat plane 2782 may be formed to have asperities (rough face) using sand blasting process, for example, so as to increase the contact resistance with the sphere-shaped end face 680.

The concave surface 782 and the slanted flat plane 2782 may be arranged in the intermediate part of the output shaft 780, 2780 of the movable body 78, 2078 located in the backward direction Dr rather than the end in the forward direction Dg.

The present disclosure may be applied to an exhaust valve instead of the intake valve, or may be applied to a valve timing controller which controls the valve timings of both the intake valve and the exhaust valve.

Such changes and modifications are to be understood as being within the scope of the present disclosure as defined by the appended claims.

What is claimed is:

1. A valve timing controller controlling a valve timing of a valve opened and closed by a torque transmitted to a camshaft from a crankshaft of an internal combustion engine, the valve timing controller comprising:

a housing rotating with the crankshaft;

a vane rotor rotating with the camshaft and partitioning an interior space of the housing into an advance chamber and a retard chamber in a rotation direction, a rotation phase of the vane rotor relative to the housing being changed in an advance direction or a retard direction by introducing working fluid into the advance chamber or the retard chamber;

a control valve disposed in an interlocking rotor constructed by the vane rotor and the camshaft, the control valve having a sleeve in which the working fluid flows and a spool reciprocating in the sleeve in an axial direction, the control valve controlling a flow of the working fluid relative to the advance chamber and the retard chamber based on a reciprocation of the spool in the sleeve; and a linear solenoid driving the spool to reciprocate in the axial direction, the linear solenoid including a coil generating a magnetic flux by being supplied with electricity, a fixed core through which the magnetic flux passes, a movable member integrally having a movable core disposed on an inner circumference side of the fixed core and an output shaft to which the spool is contact, the output shaft reciprocating in the axial direction together with the movable core when the magnetic flux passes through the fixed core and the movable core, and a bearing portion supporting an outer circumference side of the movable member in a manner that the movable member reciprocates and rotates, wherein the output shaft has an end surface that contacts a sphere-shaped end face of the spool, at a contact position offset in a radial direction from a center axis of the spool.

2. The valve timing controller according to claim 1, wherein the end surface of the output shaft is a slant surface slanted relative to a plane perpendicular to the axial direction.

3. The valve timing controller according to claim 1, wherein the linear solenoid further includes a casing having an internal chamber into which the working fluid flows from the sleeve, and the internal chamber receives the fixed core and the movable core.

4. The valve timing controller according to claim 1, wherein the control valve has a biasing component biasing the spool toward the output shaft in the axial direction, and the biasing component causes the sphere-shaped end face to pressingly contact the end surface of the output shaft when the spool is biased toward the output shaft.

5. The valve timing controller according to claim 1, wherein the end surface of the output shaft has a concave shape coaxially recessed in the axial direction, and a dimension of the concave shape in the radial direction is reduced as separating from the spool in the axial direction.

6. The valve timing controller according to claim 5, wherein the contact position defines a circumference shape at which the end surface of the output shaft and the sphere-shaped end face of the spool contact with each other.

7. The valve timing controller according to claim 1, wherein the end surface of the output shaft is provided as a slanted flat plane non-perpendicular to the axial direction, and a distance between the slanted flat plane of the output shaft and the sphere-shaped end face of the spool in the axial direction is increased as separating from the contact position in the radial direction.

8. The valve timing controller according to claim 7, wherein the slanted flat plane of the output shaft and the sphere-shaped end face of the spool contact with each other at the contact position defined by a point.

9. The valve timing controller according to claim 1, wherein the end surface of the output shaft has asperities.

* * * * *